United States Patent [19]

Sutton

[11] 4,432,110

[45] Feb. 21, 1984

[54] CUSHIONING STRUCTURE

[75] Inventor: James B. Sutton, Longton, England

[73] Assignee: Harrison & Jones (Brookside) Limited, Oldham, England

[21] Appl. No.: 282,154

[22] Filed: Jul. 10, 1981

[30] Foreign Application Priority Data

Jul. 11, 1980 [GB] United Kingdom ..... 8022774

[51] Int. Cl.[3] ..... A47C 27/22; A47C 27/14

[52] U.S. Cl. ..... 5/481; 297/DIG. 1

[58] Field of Search ..... 5/481, 449, 450, 465; 247/DIG. 1, 456

[56] References Cited

U.S. PATENT DOCUMENTS 3,064,279 11/1962 Finkle ..... 5/481
3,840,920 10/1974 Voelker ..... 5/450
3,900,648 8/1975 Smith ..... 5/481
4,184,237 1/1980 Blankenship ..... 5/481

FOREIGN PATENT DOCUMENTS 81890 12/1976 Australia ..... 297/DIG. 1

*Primary Examiner*—Alexander Grosz
*Attorney, Agent, or Firm*—Gipple & Hale

[57] ABSTRACT

Numerous types of cushioning structure have been proposed as alternatives to the feather filled cushion. In order to provide a cushioning structure which is aesthetically appealing and which is comparable in comfort to a feather filled cushion the invention provides a flexible foam casing (1) within which is accommodated a stockinette bag (15) containing shredded or crumbed flexible foam pieces (17). Preferably the inner faces (11,13) of the foam casing (1) are profiled in the form of fingers.

7 Claims, 5 Drawing Figures

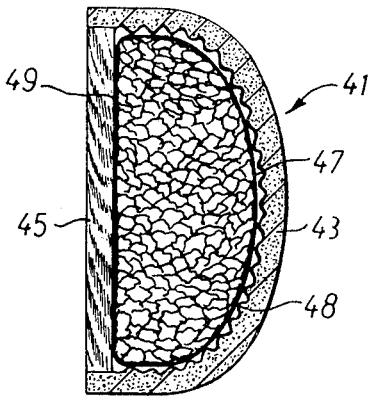
Fig 4a
Fig 4b
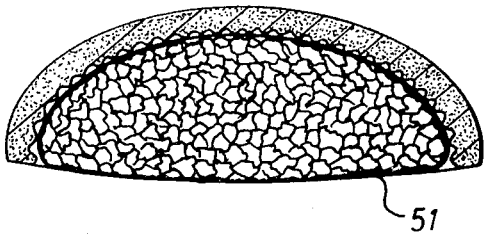
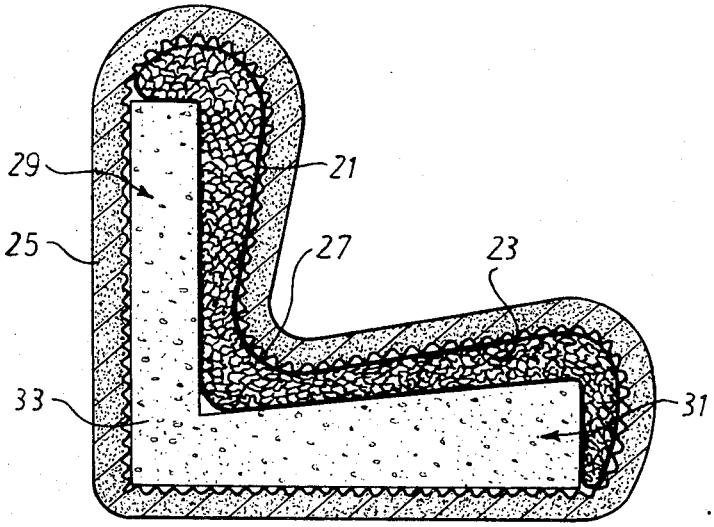
Fig 3

CUSHIONING STRUCTURE

DESCRIPTION

The present invention relates to a cushioning structure and in particular to a foam cushion as used in soft furnishings, bedding and the like.

It is known to use, as an alternative to feather of fibre filled cushions, a block of flexible foam surrounded by a decorative cover. However a cushion of this type, utilising a one piece block of flexible foam, has proven to be less comfortable and appealing to the eye than loose filled feather or fibre cushions.

As an alternative it has been proposed to fill a closed fabric bag with shredded flexible foam. The shape of such a cushion is to a large extent governed by the fabric of the bag which is constructed by sewing together appropriately shaped pieces of fabric. Whilst cushions of this type utilise cheap foam offcuts, the cost of production is increased because of the additional cost of sewing together the fabric bag and the additional time taken to fill the bag evenly with the loose foam. Also, the cushions are considered to be less comfortable than loose filled feather or fibre cushions and are known to have an inferior life performance to slab foam cushions.

Another known cushioning structure, in the form of a pillow, comprises a casing of flexible foam material whose inner faces are formed with a finger profile and a flexible foam sheet is disposed between the profiled faces. A cushion utilising this type of construction whilst being economical in its construction has proved unsatisfactory as regards its comfort and asthetic appearance.

It is an object of the present invention to provide an alternative to the loose filled feather or fibre cushion which is more comfortable than foam cushions known heretofore and which is economical and easy to manufacture.

According to the present invention there is provided a cushioning structure comprising a bag containing a loose packed filling received within a casing defined at least in part by an overlying flexible foam facing member.

According to a preferred embodiment of the invention the cushioning structure comprises a bag containing a loose packed flexible foam filling and a flexible foam casing which surrounds the foam filled bag.

Conveniently the bag is a stockinette bag and the flexible foam filling is shredded or crumbed flexible foam. Preferably an internal face of the overlying facing member or at least one internal face of the foam casing is formed with a finger profile.

A particularly advantageous construction results when the fabric bag is of extensible construction, for example stockinette.

A stockinette bag is easily filled with the shredded foam and can itself be easily inserted into the flexible foam casing. Because of the extensibility of the bag the contents are free to distribute themselves within the casing whilst being retained by the bag.

Providing the flexible foam casing with a finger profile on one or more of the faces adjacent to the foam filled stockinette bag produces a cushion which is particularly comfortable.

The filling may be of granular or shredded plastics material.

In an embodiment of the cushioning structure for complete units of upholstery, loose inserts of preferably a plastics material, for example rigid or semi-rigid foamed polystyrene, are positioned within the casing to give stability to the structure.

The present invention will now be described further, by way of example only, with reference to the accompanying drawings, in which:

FIG. 3 is a sectional view of a modified embodiment of the cushioning structure, and FIGS. 4*a* and 4*b* show a cushioning structure illustrating respectively a rigid frame and a fabric as the support member.

Figure 1:
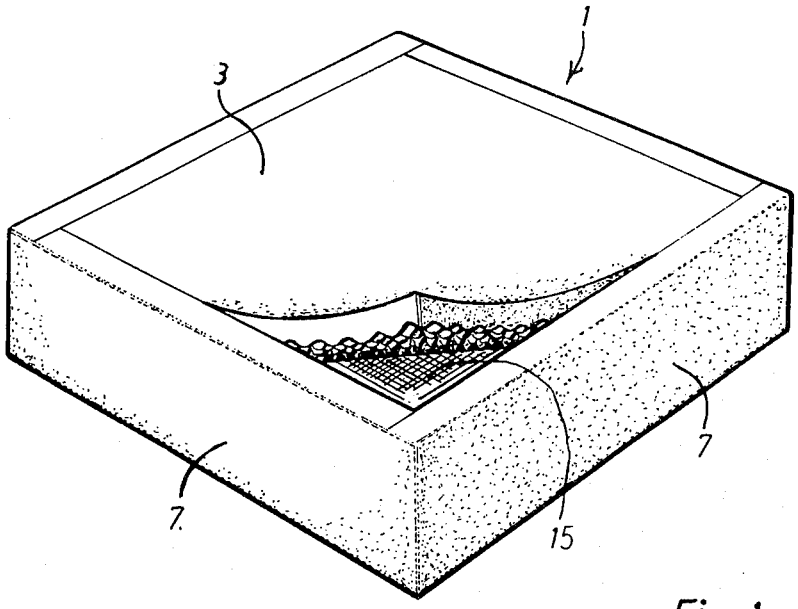
FIG. 1 is a perspective view of one embodiment of a cushioning structure in accordance with the invention with a facing member partially lifted to reveal the internal filling.
Figure 2:
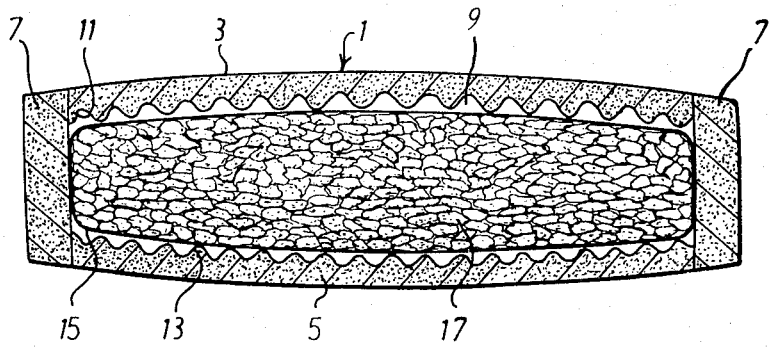
FIG. 2 is a sectional view of the embodiment of FIG. 1.

The drawings of FIGS. 1 and 2 illustrate one embodiment of a cushioning structure, in the form of a cushion, in accordance with the invention. The cushion comprises a casing 1 which as illustrated is constructed by bonding together two facing members 3, 5 and four side members 7, (only two of which are illustrated). The utilising cushion is in the form of a generally rectangular box having an internal cavity 9.

The walls of the casing are made from any flexible foam, for example standard polyether foam; high resilience foam; polyester foam; or reconstituted foam. The thickness of the foam is chosen in dependence upon the shape and size of the cushion.

As illustrated in FIG. 2 the facing members 3,5 have profiled inner faces 11,13 in the form of upstanding projections or fingers. The profiled foam may be formed by cutting or moulding. It is not essential that the casing has one or more internal faces profiled, but such a construction improves the comfort of the cushion and facilitates even distribution of the contents.

A bag 15 filled with a plurality of flexible foam pieces 17 is contained within the cavity 9 of the casing 1. The bag is preferably an expansible material, for example stockinette although other materials which are not expansible may be used. A particularly advantageous construction results when stockinette is used because its expansibility allows the bag to be easily inserted into the casing and permits the contents to distribute within the casing, thus avoiding any irregular lumps or hollows.

The flexible foam filling may be any flexible foam such as standard polyether foam; high resilience foam; polyester foam, or reconstituted foam. The foam is shredded or crumbed so as to produce a loose filling material for inserting into the stockinette bag.

In the case of the embodiment illustrated, the casing would be fabricated by bonding together the component parts, with the exception of one side member 7 which is bonded in position after the stockinette bag filled with shredded foam has been inserted into the casing.

The stockinette bag has an open end which is folded over after the bag is filled with the foam.

Alternatively the open end may be taped, clipped or sewn to prevent the foam filling from escaping.

Whilst the invention has been described with reference to a rectangular cushion having a casing made up of several parts bonded together, other shapes and constructions are envisaged. For example the cushion may comprise two sheet foam facing members secured together around the peripheral edges and having a loose foam filled stockinette bag received between the two foam sheets forming the casing. The casing may be rectangular, pillow shaped, circular or preshaped into any other convenient contour.

In an alternative embodiment (not illustrated) the cushioning structure comprises a stockinette bag filled with shredded or crumbed foam and a foam facing member which overlies the foam filled stockinette bag and which is secured to a support member. The support member and the foam facing member defines a casing within which the foam filled stockinette bag is received. The support member may for example, be a piece of fabric or a frame forming part of a seat back or a seat base to which the cushioning is applied.

In the embodiment illustrated in FIG. 3, the cushioning structure forms an upholstery unit and comprises a stockinette bag 21 loosely filled with crumbed or shredded foam 23. The bag containing the "spaghetti" foam is received within a foam casing 25 which has a finger profile 27 on its internal surface and which is formed into the required shape for the upholstery seating unit. In the illustrated embodiment the upholstery unit is generally L-shaped with curved limbs 29,31. In order to impart stability and a certain rigidity to the upholstery unit one or more inserts 33 are incorporated within the casing 25. The block 33 illustrated is a one piece, elongate L-shaped block, but in an alternative this may be replaced by two rectangular blocks disposed at right angles to one another. The blocks may be bonded together to form the elongate L-shaped block. The insert is preferably a plastics material, for example a rigid or semi-rigid foamed polystyrene. Other materials may be used for the insert such as wood or fibre board. The block 33 is not fixed within the casing and by virtue of this fixing is permitted to float.

The shape of the outer casing 25 may be used to aid the correct positioning of the bag 21 within the casing so as to create the appropriate curve on the limbs 29,31.

Referring to FIG. 4*a* there is shown a cushioning structure in which the casing 41 is formed in part by a flexible foam facing member 43 and in part by a rigid frame 45. The rigid frame constitutes a support member. A stockinette bag 47 is received within the casing and contains a loosely packed filling 49 of crumbed or shredded foam. The foam facing member is formed with a finger profile 48 on its inner surface.

FIG. 4*b* shows a similar cushioning structure to FIG. 4*a*, and the same reference numerals have been used for corresponding parts. The support member of this structure which defines part of the casing is formed by a textile fabric 51 to which the foam facing member 43 is secured. This cushioning structure contains a stockinette bag 47 filled with crumbed or shredded foam.

A granular or shredded plastics material may be used in place of the flexible foam filling.

I claim:

1. A cushioning structure comprising a flexible foam plastic casing having an internal face which is formed with a finger profile, a stockinette bag received within the casing, and a filling of shredded flexible foam plastic loosely packed within the bag.

2. A cushioning structure according to claim 1, further comprising a flexible foam facing member and wherein a support member defines at least a part of the casing and the facing member is secured to the support member.

3. A cushioning structure according to claim 2, wherein the support member is a textile fabric.

4. A cushioning structure according to claim 2, in which the support member is a substantially rigid frame.

5. A cushioning structure according to claim 1, wherein a substantially rigid insert is loosely received within the casing to add stability to the structure.

6. A cushioning structure according to claim 5, in which the insert comprises at least one elongate polystyrene block.

7. A cushioning structure according to claim 6, wherein the insert is L-shaped.

* * * * *